US005831507A

United States Patent [19]

Kasamatsu et al.

[11] Patent Number: 5,831,507

[45] Date of Patent: Nov. 3, 1998

[54] DUAL-FUNCTIONAL FUSE UNIT THAT IS RESPONSIVE TO ELECTRIC CURRENT AND AMBIENT TEMPERATURE

[75] Inventors: Mikizo Kasamatsu, Neyagawa; Hideki Shoji, Iwaki, both of Japan

[73] Assignee: Toyo System Co., Ltd., Iwaki, Japan

[21] Appl. No.: 841,147

[22] Filed: Apr. 29, 1997

[30] Foreign Application Priority Data

Sep. 9, 1996 [JP] Japan ..... 8-238202
Dec. 10, 1996 [JP] Japan ..... 8-330050

[51] Int. Cl.[6] ..... H01H 37/76; H01H 85/00

[52] U.S. Cl. ..... 337/4; 337/407; 337/403; 337/299; 337/300; 337/5

[58] Field of Search ..... 337/4–5, 35, 299, 337/401–409, 143, 163–166, 232, 238–241, 265–267, 183, 184, 244, 300

[56] References Cited

U.S. PATENT DOCUMENTS 4,276,532 6/1981 Aoki ..... 337/408
4,570,147 2/1986 Ebi ..... 337/166
4,593,262 6/1986 Krueger ..... 337/163
4,727,348 2/1988 Okazaki ..... 337/403
5,014,036 5/1991 Komoto ..... 337/407
5,463,366 10/1995 Hassler et al. ..... 337/176

*Primary Examiner*—Leo P. Picard
*Assistant Examiner*—Anatoly Vortman
*Attorney, Agent, or Firm*—Kenjiro Hidaka

[57] ABSTRACT

A dual-functional fuse unit, which is responsive to an electric current and an ambient temperature, contains a current sensing fuse and a temperature sensing fuse element. The current sensing fuse is serially connected with and between lead terminals of the fuse unit directly or through an intermediate conductor member. The current sensing fuse or the intermediate conductor member is urged but kept from moving when the temperature sensing fuse element is in a solid state. When the fuse element melts at a specified ambient temperature the urged current sensing fuse or the intermediate conductor member is displaced by the urging force so that the lead terminals are electrically disconnected from each other. In other embodiment, an urged cutter member in the case is normally kept from moving but is driven to sever the element of the current temperature fuse when the temperature sensing fuse element melts at a specified ambient temperature.

9 Claims, 16 Drawing Sheets

DUAL-FUNCTIONAL FUSE UNIT THAT IS RESPONSIVE TO ELECTRIC CURRENT AND AMBIENT TEMPERATURE

BACKGROUND OF THE INVENTION

1. Field of the Invention

The present invention pertains to a dual-functional fuse unit that is functional in response to both an excessive electric current and an excessive ambient temperature. The fuse unit contains in a single casing a current sensing fuse that is responsive to a specified electrical current and a temperature sensing fuse element that melts at a specified ambient temperature.

2. Description of the Prior Art

A current sensing fuse is a fuse whose element melts by a joule heat generated by an excessive amount of electrical current that flows through an electrical circuit to be protected with which the fuse is connected in series, thereby interrupting the current in the circuit. An ambient temperature sensing fuse has a fuse element that yields to an excessive ambient temperature in an electrical circuit or equipment that is to be protected, thereby causing to interrupt the current supply to the circuit or equipment.

Rise of temperature in an electrical equipment causes rise of a circuit conductor temperature in the equipment and this results in a rise of the conductor resistance, which in turn causes to reduce the current flowing through the conductor and a current sensing fuse that is connected with the conductor in series. The action of the current sensing fuse can be undesirably delayed because of this reason. Then, any electrical part or element in the circuit may be damaged from excessive heat in the equipment before the current sensing fuse in the circuit acts to protect the part or element. An ambient temperature sensing fuse that acts in response to an excessive temperature in the equipment is, therefore, useful.

FIGS. 15(A) and 15(B) show a fuse 50 that is one of conventional ambient temperature sensing fuses. This type of fuse is also called "thermal cutoff". The fuse 50 shown in FIG. 15(A) is before action and in FIG. 15(B) after action. The fuse 50 has a pellet 51, which is a temperature sensing fuse element, compression coil springs 52 and 53, an electrically-conductive cylindrical body 54, an electrically-conductive sliding contact 55, and a pair of lead wires 56 and 57. The contact 55 is interposed between the springs 52 and 53 slidably in contact with the internal wall of the body 54. The lead wire 56 is insulated from the case 54 but the lead wire 57 is electrically connected with the case 54. When the pellet 51 melts at a specified temperature the pellet 51 yields to the expansion forces of the coil springs 52 and 53, as shown in FIG. 15(B), so that the contact 55 comes apart from the lead wire 56 and the lead wires 56 and 57 are electrically disconnected from each other.

FIGS. 16(A) and 16(B) show another type of conventional ambient temperature sensing fuse 60. FIG. 16(A) shows the fuse 60 before action and FIG. 16(B) in action. The fuse 60 has lead wires 61 and 62, a temperature sensing fuse element 63, which is directly connected with and between the lead wires 61 and 62, and an insulating tubular body 64. The fuse element 63 is made of an alloy having a low yielding temperature. When the ambient temperature rises to a specified level, the fuse element 63 melts down, thereby causing the lead wires 61 and 62 to be electrically disconnected with each other.

The fuse 50 shown in FIGS. 15(A)(B) has a body length of more than 10 mm and this size is often considered too large to be used with a miniature current sensing fuse. The fuse 60 shown in FIGS. 16(A)(B) can be made smaller than the fuse 50. However, the circuit current flows directly through the fuse element 63 and the action of the fuse 60 is, therefore, substantially affected not only by the ambient temperature but also by the heat generation caused by the current flowing through the element 63. A conventional ambient temperature sensing fuse of this type often prematurely acts because of such heat generated by the current before the ambient temperature reaches the specified level, thereby causing the current supply to the circuit to be erroneously interrupted. This problem necessitates to take into consideration, in selection a current sensing fuse, not only the amount of maximum allowable current in the circuit but also the characteristics of the ambient temperature sensing fuse that will be used together with the current sensing fuse.

On the other hand, in order for the fuse 60 shown in FIGS. 16(A) (B) to properly function, the fuse element 63 must not only melt but also separate itself to electrically disconnect the lead wires 61, 62 from each other. This causes a fluctuation of critical temperature at which the circuit is shut off and, therefore, this type of temperature sensing fuse is less reliable.

SUMMARY OF THE INVENTION

In view of the above described situation, the primary object of the present invention is to provide a small and reliable dual-functional fuse unit that acts in response to both an amount of current and an ambient temperature independently from each other.

In order to achieve the object, the dual-functional fuse unit, which is responsive to an electric current and an ambient temperature, according to the present invention, has a case that contains a current sensing fuse, a temperature sensing fuse element, an urging device and a holding pin. The current sensing fuse is electrically connected with and between lead terminals of the fuse unit directly or indirectly through at least one intermediate conductor member. A part of the holding pin is securely embedded in the temperature sensing fuse element when the element is in a solid state. The current sensing fuse or the intermediate conductor member is urged by the urging device, such as a coil spring, but the holding pin causes the current sensing fuse or the intermediate conductor member to be kept from being displaced as long as the temperature sensing fuse element is in a solid state. When the temperature sensing fuse element melts at a specified ambient temperature the holding pin is freed from the hold by the fuse element. This causes the current sensing fuse or the intermediate conductor member to be displaced by the urging force and, consequently, the electrical connection between the lead terminals are cut off.

In other embodiment of the present invention, the temperature sensing fuse element is interposed between an inside wall of the case and the current sensing fuse and the current sensing fuse is urged against the temperature sensing fuse element but is kept from moving by the fuse element as long as the fuse element is in a solid state. When the fuse element melts at a specified ambient temperature the fuse element yields to the urging force and, consequently, the current sensing fuse is displaced by the urging force, whereby the lead terminals are electrically disconnected from each other.

In an additional embodiment of the present invention, the fuse element of the current sensing fuse is severed by an urged cutter member that is normally kept from moving by the temperature sensing fuse element but is driven to the fuse element of the current sensing fuse to sever the element when the temperature sensing fuse element melts at a specified ambient temperature.

DETAILED DESCRIPTION OF THE PREFERRED EMBODIMENTS

Embodiments of the present invention will now be described in detail in reference to the drawings.

Figure 1:
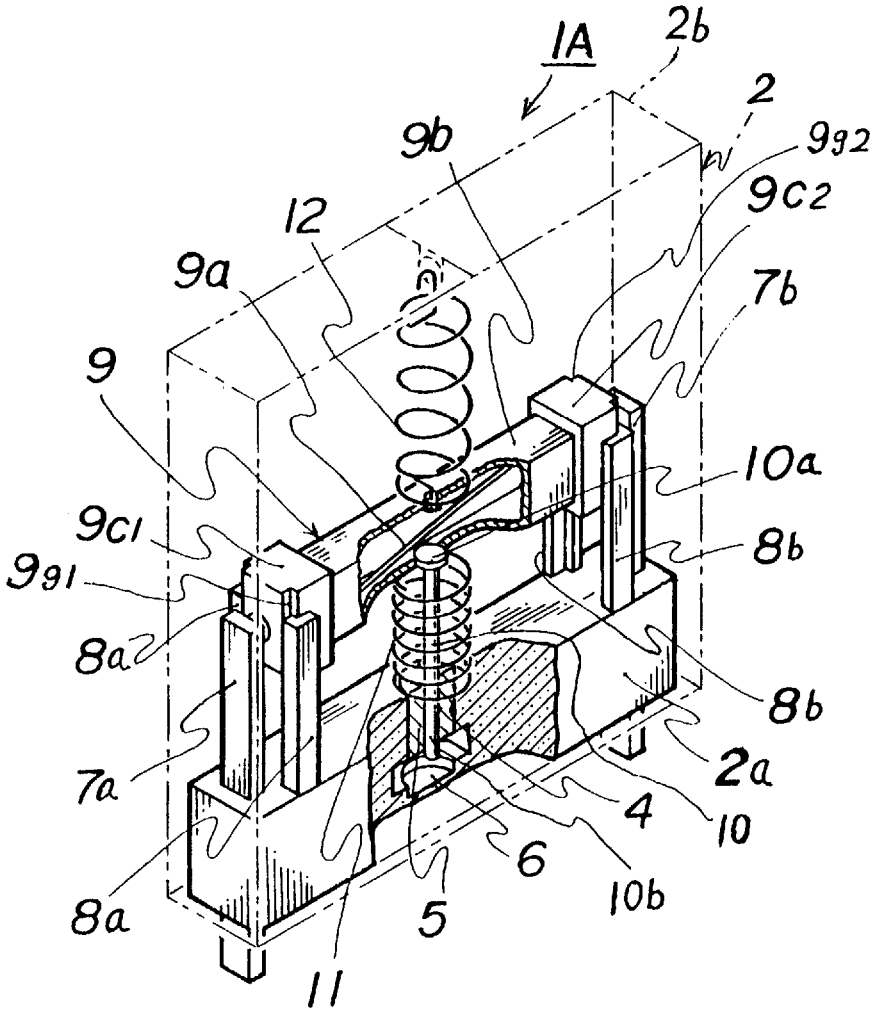
FIG. 1 is a partially cutout general perspective view of a dual-functional fuse unit that is responsive to electric current and ambient temperature according to the first embodiment of the present invention.
Figure 2:
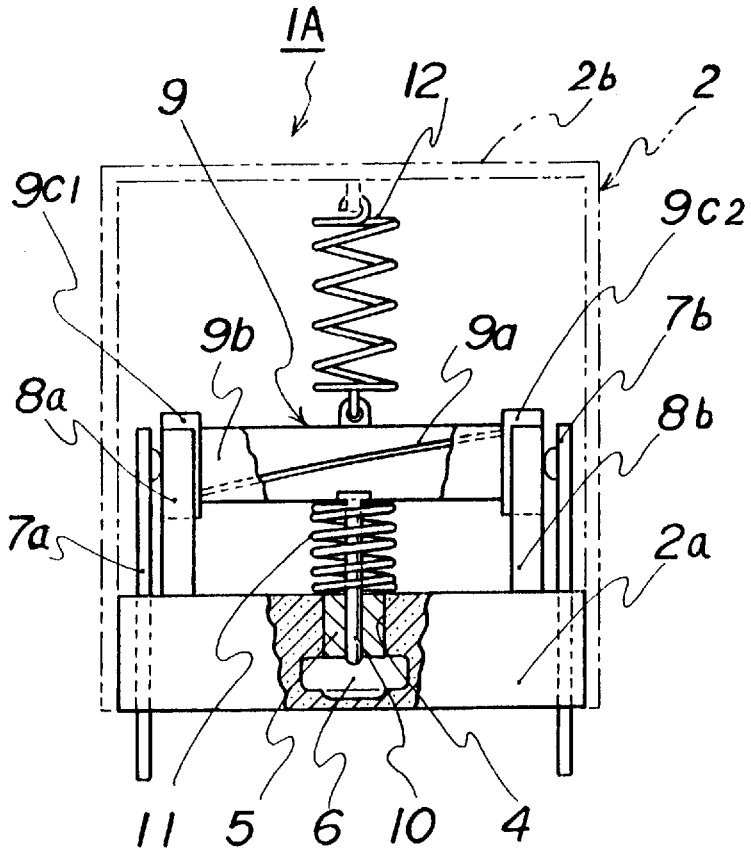
FIG. 2 is a partially cutout elevational view of the fuse unit shown in FIG. 1.
Figure 3:
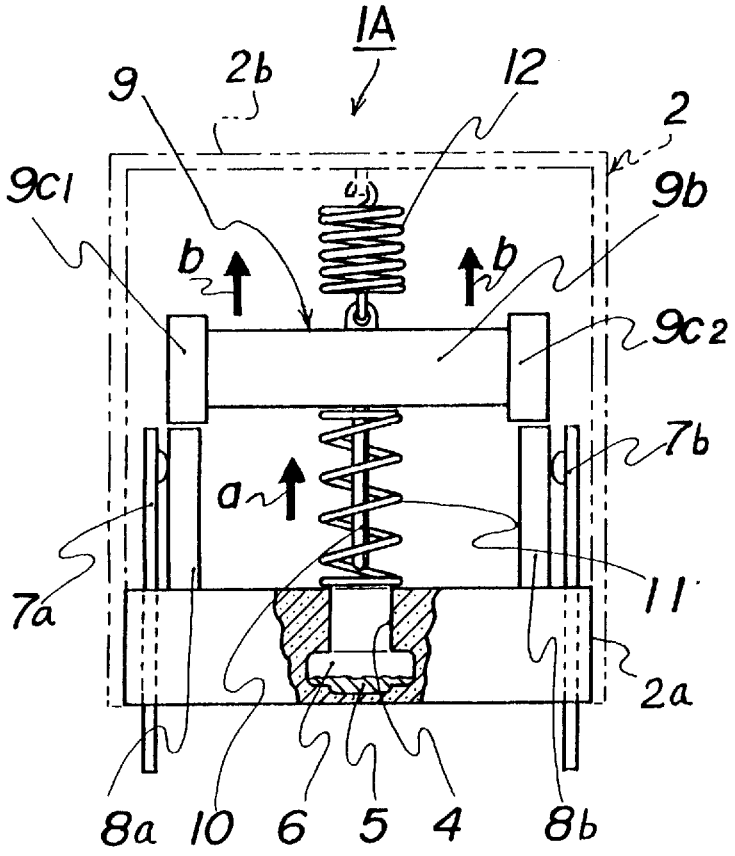
FIG. 3 shows the fuse unit shown in FIG. 2 in a state of action.

FIGS. 1 and 2 show a dual-functional fuse unit 1A that is responsive to electric current and ambient temperature according to the first embodiment of the present invention. FIG. 3 shows the same fuse unit in a state of action in response to an ambient temperature.

Referring to FIGS. 1, 2 and 3, the fuse unit 1A consists mainly of a case 2, which includes a base 2*a* and a housing cap 2*b* hermetically attached to the base 2*a*, a temperature sensing fuse element 5, a pair of electrically-conductive lead terminals 7*a*, 7*b*, pairs of current sensing fuse supporting posts 8*a*, 8*b*, a current sensing fuse 9, a holding pin 10, and coil springs 11 and 12.

The base 2*a* is a rectangular installation base made of an electrically non-conductive material, such as porcelain, resin, or a compound thereof. A cylindrically-shaped temperature sensing element holding hole 4 is provided in an approximate center of the base 2*a* in order to hold therein the temperature sensing fuse element 5. The base 2*a* and the housing cap 2*b* may be made in any proper forms suitable to the physical installation environment of the fuse unit rather than the rectangular form shown in the drawings.

Under the hole 4 is formed a drain hole 6 to receive molten temperature sensing fuse element 5. Namely, the temperature sensing fuse element 5 normally stays in the hole 4 in a solid state, as shown in FIGS. 1 and 2, but when the fuse element melts at a specified ambient temperature the molten element flows down into the drain hole 6, as shown in FIG. 3.

Figure 4:
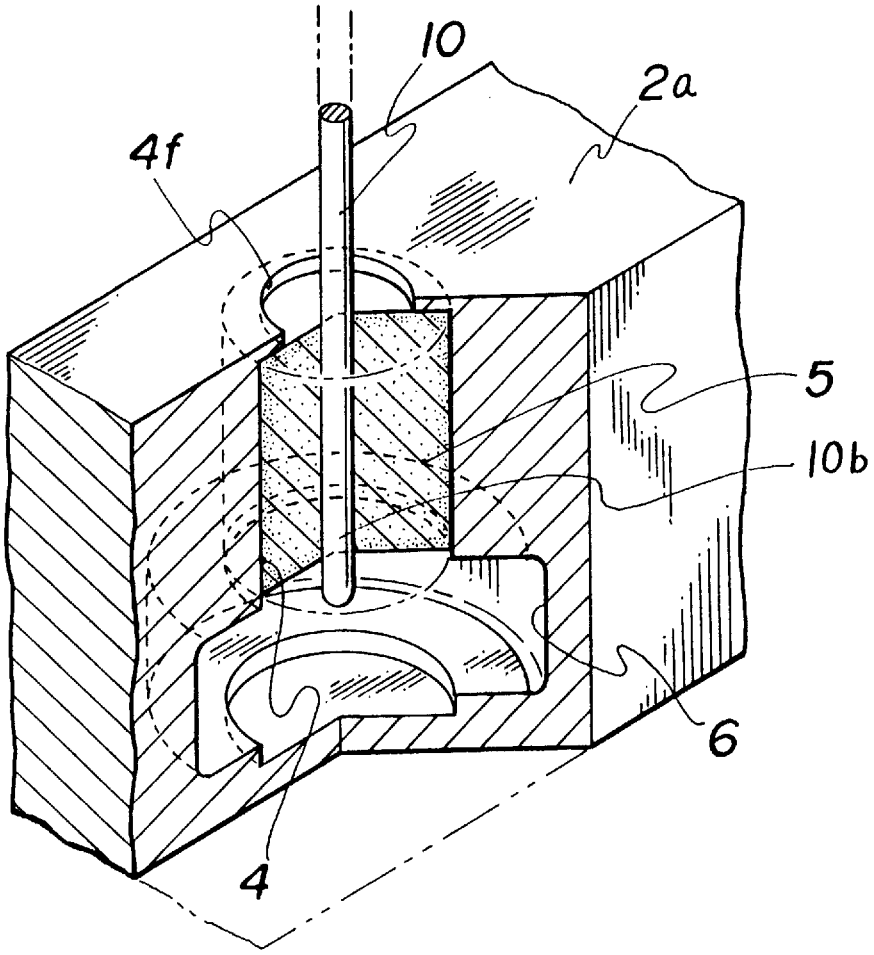
FIG. 4 is a partially cutout, enlarged perspective view of a part of the fuse unit shown in FIGS. 1 to 3.

FIG. 4 shows a part of the base 2*a* including the hole 4 and the drain hole 6. The hole 4 has a diametrically narrowed top opening 4*f*, which is intended to prevent the temperature sensing fuse element 5 from slipping upwardly out of the hole 4.

The temperature sensing fuse element 5 is made of an alloy having a low melting temperature. An organic compound such as thermosetting resin, an inorganic compound such as glass, a metal such as tin or lead, or a metal oxide may also be used for the fuse element 5. The selection of the material will primarily be made in consideration of the required fusing temperature and the desired physical strength when the material is set in the hole 4.

The lead terminals 7*a*, 7*b* are vertically fixed to the base 2 near each side end thereof through the base 2*a* in a manner that bottom parts thereof are extended under the base 2*a*. The supporting posts 8*a*, 8*b* are angled and vertically fixed to the base 2*a* adjacent to the lead terminals 7*a*, 7*b*, respectively.

The current sensing fuse 9 consists of a fuse element 9*a*, a body 9*b*, which is made of an insulating material such as ceramics, and a pair of electrically-conductive end contacts 9*c*1, 9*c*2. The end contacts 9*c*1, 9*c*2 are fitted to the ends of the body 9*b* and the fuse element 9*a* is diagonally disposed in the body 9*b* between the end contacts 9*c*1 and 9*c*2. The fuse element 9*a* is made of a material that melts when an excessive amount of current flows therethrough. The current sensing fuse 9 is, functionally, like a conventional current sensing fuse.

The holding pin 10 is vertically disposed in a manner that a top part 10*a* thereof is attached to the body 9*b* of the current sensing fuse 9 and a bottom part 10*b* thereof is securely embedded in the temperature sensing fuse element 5. The holding pin 10 may be a member having any other proper form provided that a part of the member is securely held by the temperature sensing fuse element 5 when the element 5 is in a solid state and another part attached to the body 9*b*.

Referring to FIG. 1, each of the end contacts 9*c*1 and 9*c*2 has a pair of grooves 9*g*1 and 9*g*2, respectively, and the angled supporting posts 8*a* and 8*b* slidably engage with the end contacts 9*c*1 and 9*c*2, respectively, in the grooves 9*g*1 and 9*g*2, respectively. Thus, the end contacts 9*c*1 and 9*c*2 are removably held by friction between the pairs of the supporting posts 8*a* and 8*b*, respectively, while maintaining contracts with the lead terminals 7*a* and 7*b*, respectively.

Between a longitudinal mid section of the body 9*b* of the current sensing fuse 9 and the periphery of the hole 4 of the base 2*a* is vertically disposed a lower coil spring 11 in a manner that the coil spring 11 is compressed between the base 2*a* and the body 9*b* and the holding pin 10 is through the coil spring 11. Thus, the current sensing fuse 9 is urged by the coil spring 11 in a direction away from the temperature sensing fuse element 5 but is kept from moving by the holding pin 10 that is securely held by the temperature sensing fuse element 5.

Since the top part 10*a* of the holding pin 10 is attached to the body 9*b,* not only the pin 10 but also the coil spring 11 are kept from moving laterally.

A top part of the body 9*b* of the current sensing fuse 9 in a longitudinal mid section thereof and a top part of the housing cap 2*b* is connected with an upper coil spring 12, which is a tension spring, so that the body 9*b* is upwardly urged by the spring 12. This upper tension spring 12 may be omitted when considered unnecessary in an application of the fuse unit 1A.

Figure 5:
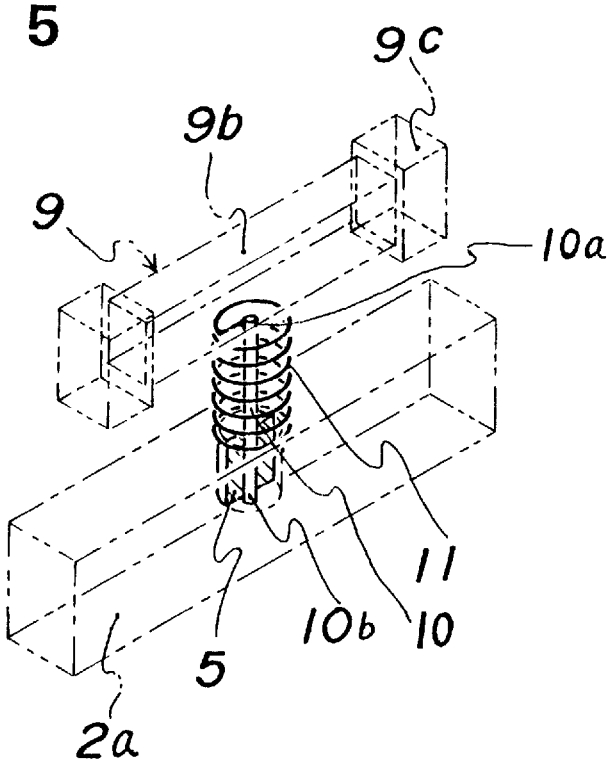
FIG. 5 shows an alternative design of the first embodiment shown in FIGS. 1 to 3.

FIG. 5 shows an alternative design of the first embodiment shown in FIGS. 1 to 4. The only difference is that, in reference to FIG. 5, the top of the lower coil spring 11 is fixedly attached to the top part 10*a* of the holding pin 10 so that the coil spring is kept from expanding by the holding pin 10 alone. In this alternative design the holding pin 10 need not be attached to the current sensing fuse 9 as long as the fuse 9 is urged by the coil spring 11 but is kept from moving when the temperature sensing fuse element 5 (FIG. 4) is in a solid state.

Now, the function of the above described fuse unit 1A will be explained.

The fuse unit 1A (so the current sensing fuse 9 as well) is electrically connected in series with a circuit to be protected through the lead terminals 7*a,* 7*b.* The current sensing fuse element 9*a* melts when an excessive amount of current flows therethrough, so that the terminals 7*a* and 7*b* are electrically disconnected with each other and the circuit is protected against excessive currents, as in the case of a conventional current sensing fuse.

The current sensing fuse 9 is normally kept from moving by the holding pin 10, which is securely held by the temperature sensing fuse element 5 when the element 5 is in a solid state. Regardless of the heat that may generate from the current sensing fuse element 9*a,* the temperature sensing fuse element 5 is responsive to the ambient temperature therearound. When the fuse element 5 melts at a specified ambient temperature, the molten element 5 drops into the drain hole 6, and the holding pin 10 is released from the fuse element 5. Then, the compressed lower coil spring 11 will expand, as indicated by arrow 'a' in FIG. 3, and the upper tension spring 12 will contract, as indicated by arrows 'b' in FIG. 3, so that the current sensing fuse 9 will be driven up by the springs 11 and 12. As the current sensing fuse 9 is driven up, the end contacts 9*c*1 and 9*c*2 will come apart from the respective lead terminals 7*a* and 7*b,* so that the lead terminals 7*a* and 7*b* are electrically disconnected with each other and current supply to the circuit will be interrupted.

Figure 6:
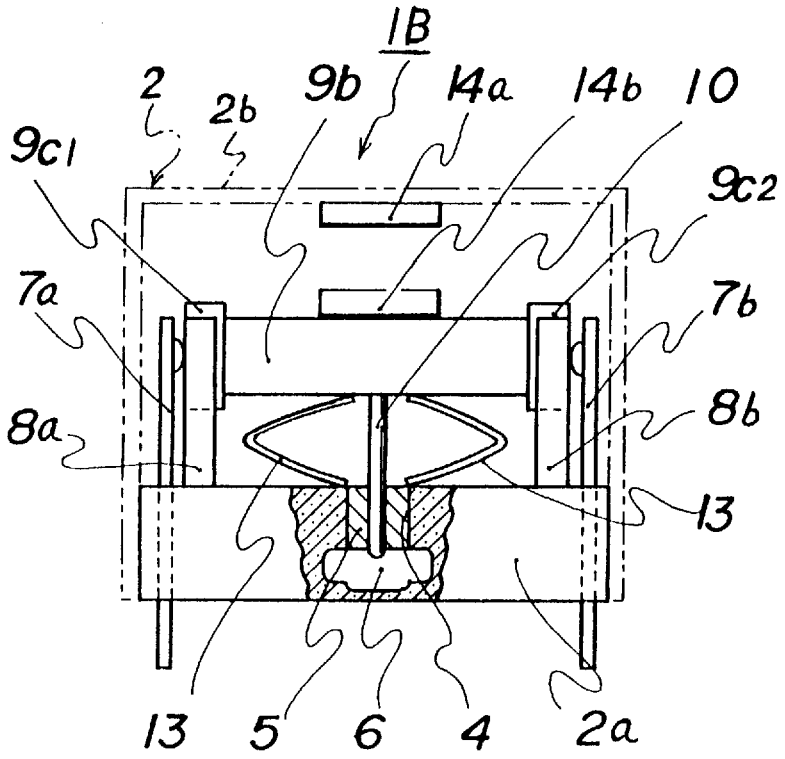
FIG. 6 shows a partially cutout elevational view of a dual-functional fuse unit according to the second embodiment of the present invention.

FIG. 6 shows a partially cutout elevational view of a dual-functional fuse unit 1B that is responsive to electric current and ambient temperature according to the second embodiment of the present invention. The fuse unit 1B is a partially modified type of the fuse unit 1A. It should be understood that like reference characters denote like parts or elements having like functions throughout this specification and the drawings. No duplicate explanation will, therefore, be made on the parts or elements having like reference characters.

In FIG. 6, a pair of leaf springs 13 are substituted for the lower coil spring 11 of the first embodiment and a pair of magnets 14*a* and 14*b,* which are attractive to each other, are substituted for the upper tension coil spring 12 of the first embodiment.

Figure 7:
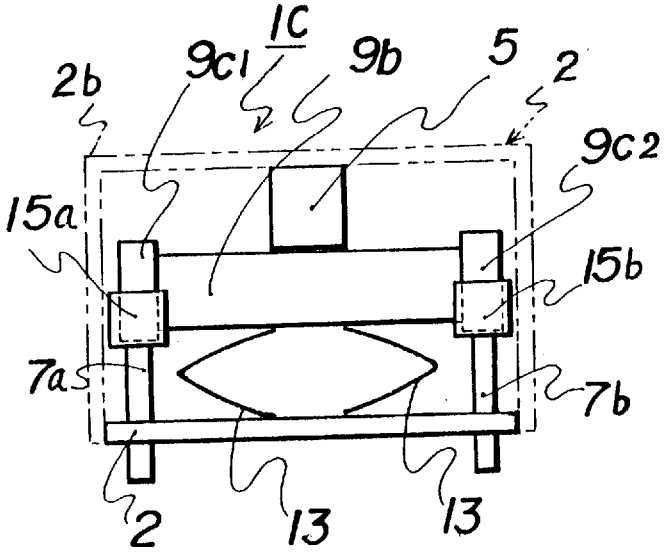
FIG. 7 shows an elevational view of a dual-functional fuse unit according to the third embodiment of the present invention.
Figure 8:
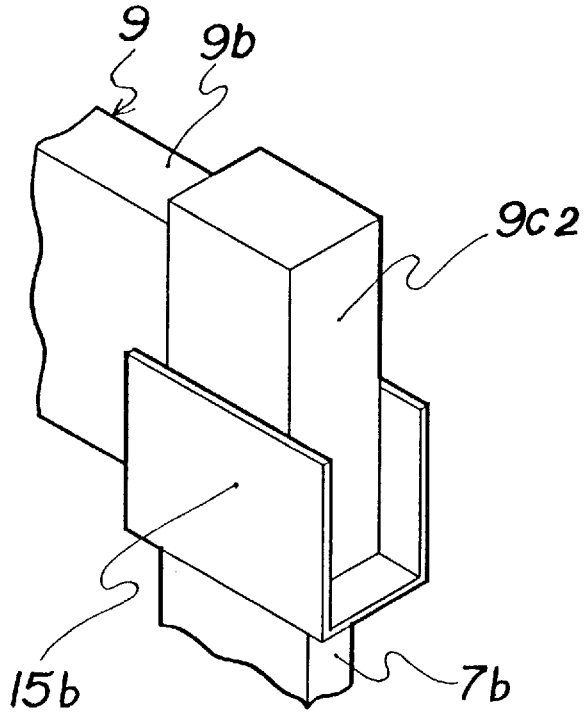
FIG. 8 is a enlarged perspective view of a part of the fuse unit shown in FIG. 7.

FIG. 7 shows an elevational view of a dual-functional fuse unit 1C that is responsive to electric current and ambient temperature according to the third embodiment of the present invention, and FIG. 8 is an enlarged perspective view of a part of the fuse unit 1C.

In FIGS. 7 and 8, an electrically-conductive U-shaped holding clips 15*a* and 15*b* are fixedly attached onto the tops of lead terminals 7*a* and 7*b,* respectively, and the end contacts 9*c*1 and 9*c*2 of the current sensing fuse 9 are fitted in the holding clips 15*a* and 15*b,* respectively, so that the fuse 9 is directly supported by the lead terminals 7*a,* 7*b.*

As shown in FIG. 7, a temperature sensing fuse element 5 is disposed between the top of the body 9*b* of the current sensing fuse 9 in a longitudinally mid section thereof and a top part of the housing cap 2*b.* A pair of leaf springs 13 are disposed between the current sensing fuse 9 and the base 2*a* in a manner that the fuse 9 is upwardly urged by the springs 13 against the fuse element 5. The urging force by the spring, therefore, is transmitted to the fuse element 5, then, to the top part of the housing cap 2*b* when the fuse element 5 is in a solid state. In this embodiment, the sliding guides 8 and the holding pin 10, as shown in FIGS. 1 to 3, are eliminated, and the base 2*a* contains neither the temperature sensing element 5 nor the drain hole 6 that are shown in FIGS. 1 to 3, and 6.

When the fuse element 5 melts at a specified ambient temperature the fuse element 5 yields to the transmitted urging force and, consequently, the current sensing fuse 9 is displaced by the urging force of the springs 13, so that the electrical connection between the lead terminals 7*a* and 7*b* is cut off.

Figure 9:
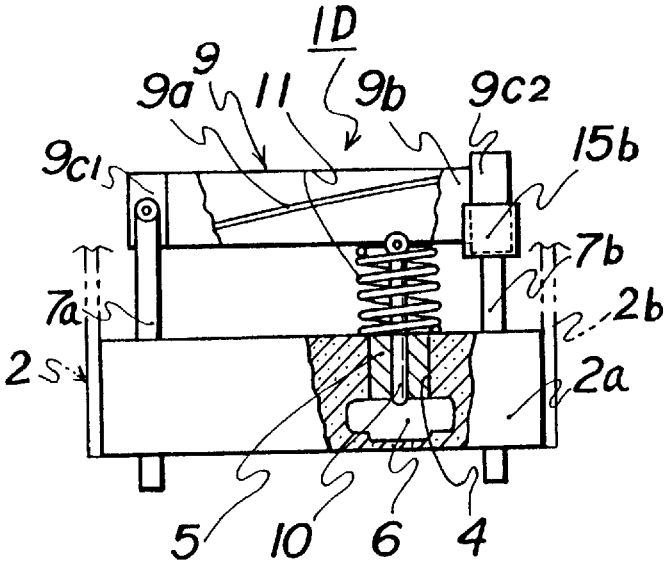
FIG. 9 is a partially cutout elevational view of a dual-functional fuse unit according to the forth embodiment of the present invention.

FIG. 9 is an elevational view of a dual-functional fuse unit 1D that is responsive to electric current and ambient temperature according to the forth embodiment of the present invention. In this embodiment, an end contact 9*c*1 of the current sensing fuse 9 is pivotally connected with the top of the lead terminal 7*a;* the top of the holding pin 10 is also pivotally connected with the body 9*b* of the fuse 9; and the end contact 9*c*2 is removably fitted in the holding clip 15*b* that is fixedly attached onto the lead terminal 7*b.* The function of the fuse unit 1D is similar to that of the fuse unit 1A except that the temperature sensing fuse 9 of the fuse unit 1D will be pivotally displaced.

Figure 10:
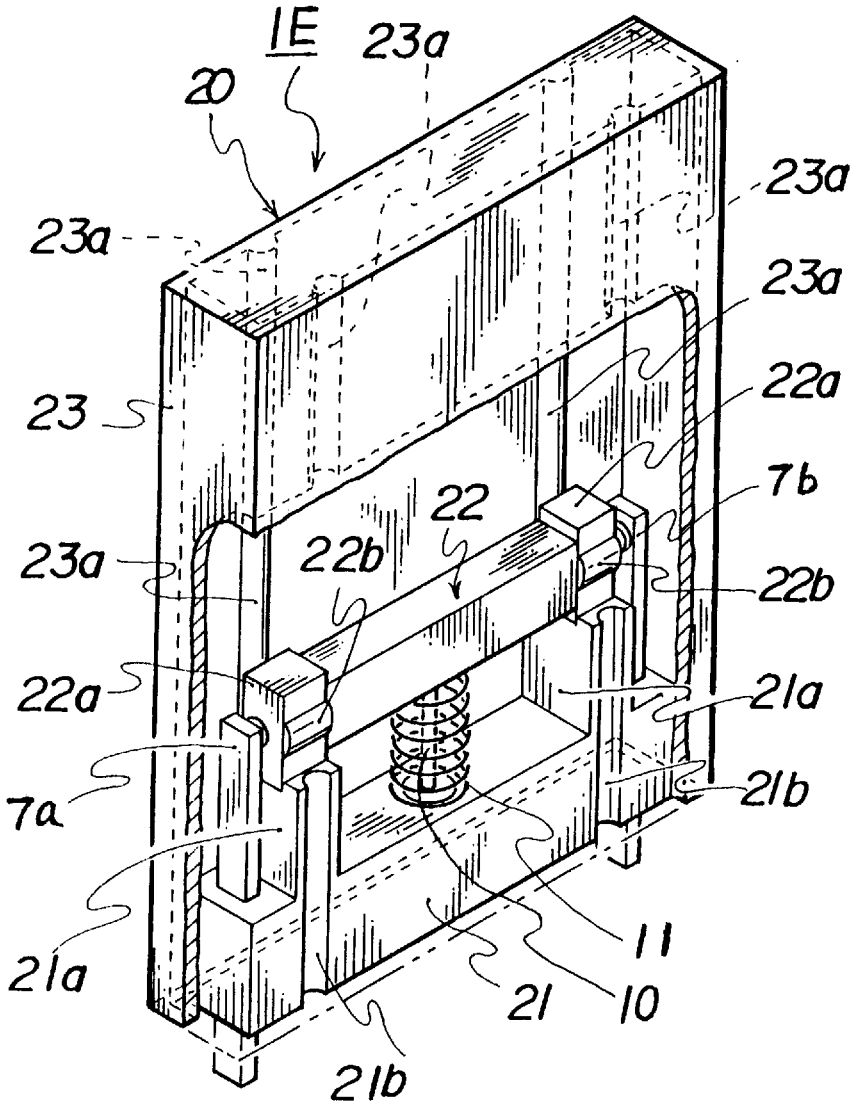
FIG. 10 is a partially cutout perspective view of a dual-functional fuse unit according to the fifth embodiment of the present invention.

FIG. 10 is a partially cutout perspective view of a dual-functional fuse unit 1E that is responsive to electric current and ambient temperature of the fifth embodiment according to the present invention. In this embodiment, a case 20 has a base 21 and a housing cap 23 fixedly attached to the base 21. The base 21 integrally has a pair of pedestals 21*a.* A current sensing fuse 22 has a pair of end contacts 22*a,* each of which lies on each of the pedestals 21*a.* A pair of vertical guide grooves 21*b* are provided on opposing sides of each pedestal 21*a* and the base 21, and vertical ribs 23*a* are provided on the inside walls of the housing cap 23 in a manner that the ribs 23*a* individually fit in the respective guide grooves 21*b.*

On the sides of the end contacts 22*a* are integrally provided projections 22*b* in a manner that the projections 22*b* individually make sliding and point contacts with the respective vertical ribs 23*a.* The end contacts 22*a* and 22*b* maintain contacts with a pair of resilient lead terminals 7*a* and 7*b,* respectively.

The structures and the functions of the temperature sensing fuse element 5 (not shown in FIG. 10), the holding pin 10 and the compression coil spring 11 shown in FIGS. 9 and 10 are the same as those of the fuse unit 1A of the first embodiment shown in FIGS. 1 to 4.

When the temperature sensing fuse element (not shown in FIG. 10) of the fuse unit 1E melts, the holding pin 10 will be released from the fuse element and the current sensing fuse 22 will be driven up by the compression coil spring 11. The fuse 22 will, then, come apart from the pedestals 21*a* and the lead terminals 7*a,* 7*b,* and slide up between the vertical ribs 23*a* while the projections 22*b* are maintaining contacts with the respective vertical ribs 23*a*. Since the projections 22*b* and the vertical guide ribs 23*a* make point contacts, the sliding movement of the fuse 22 will be made with little friction.

Figure 11A:
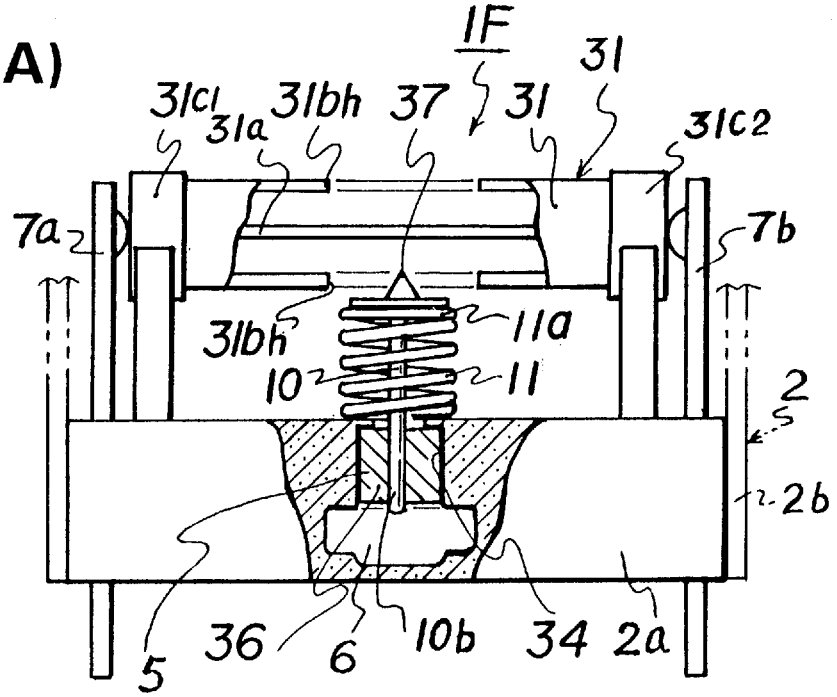
FIGS. 11(A) and 11(B) are partially cutout elevational views of a dual-functional fuse unit according to the sixth embodiment of the present invention.
Figure 11B:
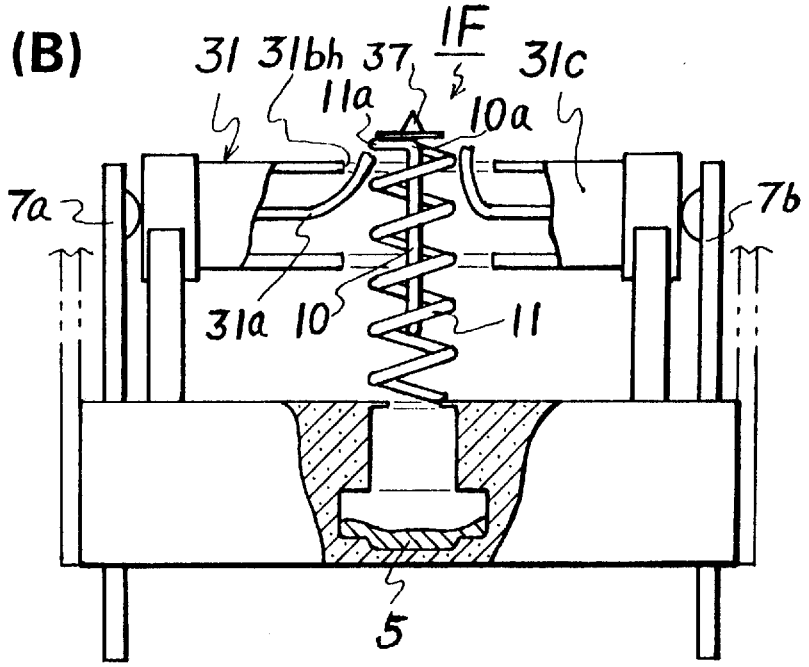

FIGS. 11(A) and 11(B) are elevational views of a dual-functional fuse unit 1F that is responsive to electric current and ambient temperature according to the sixth embodiment of the present invention. In this embodiment, an upwardly directed sharp cutter piece 37 is fixedly attached onto a top part 11*a* of a compression coil spring 11 that is kept from expanding by the holding pin 10 whose top part 10*a* (FIG. 11(B)) is fixedly attached to the top part 11*a* of the coil spring 11 and the lower part 10*b* thereof securely embedded in the temperature sensing fuse element 5 when the element 5 is in a solid state.

The fuse unit 1F contains a current sensing fuse 31 that has a fuse element 31*a,* a body 31*b,* and end contacts 31*c*1, 31*c*2. Unlike the cases of the above described embodiments, the fuse body 31*b* has a hole 31*bh* in the middle section thereof vertically opposing the coil spring 11, so that a top section of the coil spring 11, together with the cutter piece 37, enter the hole 31*bh* when the spring 11 is allowed to expand.

The cutter piece 37 is kept from moving as long as the temperature sensing fuse element 5 is in a solid state. As the fuse element 5 melts at a specified ambient temperature, the lower part 10*b* of the holding pin 10 will be released therefrom and the coil spring 11 upwardly extends into the hole 31*bh* of the fuse body 31*b* and the cutter piece 37 is driven to the fuse element 31*a,* so that the cutter piece 37 will sever the fuse element 31*a,* as shown in FIG. 11(B), and the electrical connection between the lead terminals 7*a* and 7*b* will be cut off.

Figure 12:
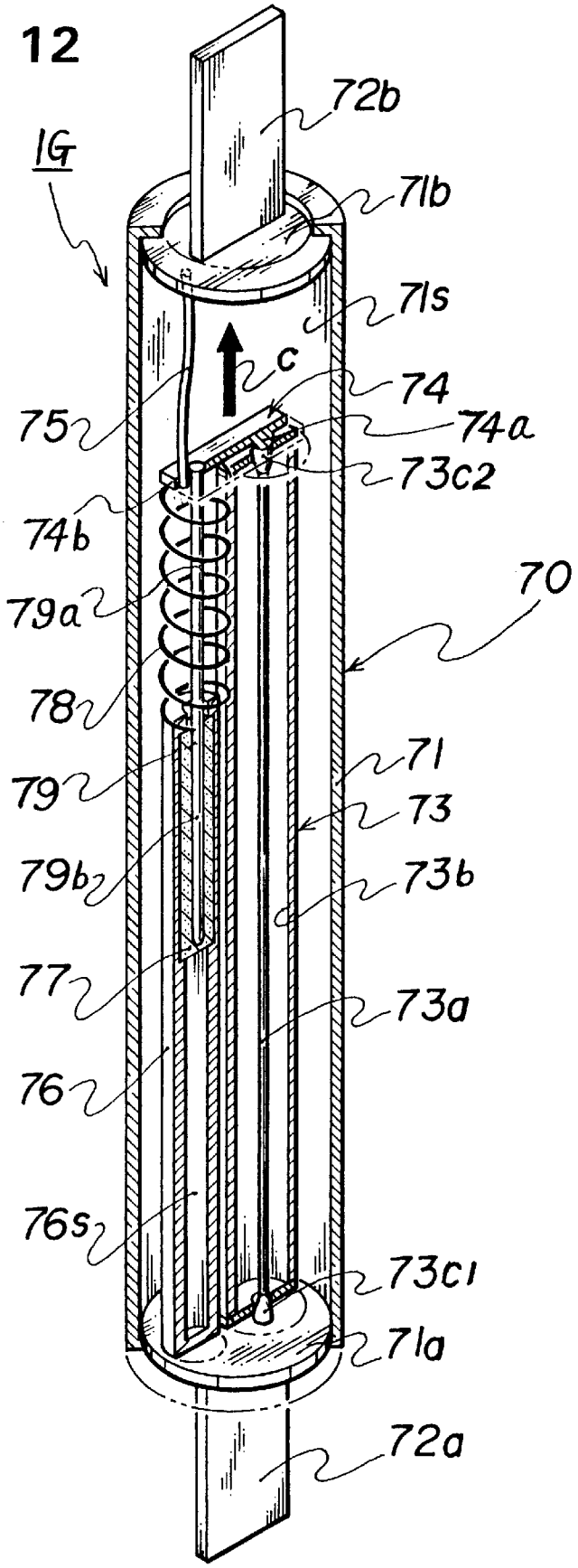
FIG. 12 is a partially cutout perspective view of a dual-functional fuse unit according to the seventh embodiment of the present invention.

FIG. 12 is a partially cutout perspective view of a dual-functional fuse unit 1G that is responsive to electric current and ambient temperature according to the seventh embodiment of the present invention.

The fuse unit 1G has an electrically non-conductive case 70 that includes a cylindrical case body 71 and a pair of end plates 71*a,* 71*b* fitted to both the ends of the case body 71. Lead terminals 72*a* and 72*b* are implanted to the end plates 71*a* and 71*b,* respectively. In the case 70 is disposed a current sensing fuse 73 that has a fuse element 73*a,* a body 73*b* and end contacts 73*c*1, 73*c*2. The end contact 73*c*1 is electrically connected with the lead terminal 72*a*. An electrically conductive elongated connecting member 74 is also disposed in the case 70 in a manner that one part 74*a* thereof is connected with the end contact 73*c*2 of the current sensing fuse 73 and another part 74*b* thereof is electrically connected with the lead terminal 72*b* with a flexible conductor wire 75. Between the connecting member 74 and the end plate 71*b* in the case 70 is a space 71*s*.

In the case 70 is additionally disposed an electrically non-conductive tubular temperature sensing element container 76 adjacent to the current sensing fuse 73 and in parallel therewith. The bottom end of the tubular container 76 is closed and attached onto the end plate 71*a* of the case 70 and the top end of the container 76 has an opening. A temperature sensing element 77 is filled in an upper section of the container 76 up to the top opening, but in a manner that the element may not slip out upwardly from the container 76. This element 77 is of the same material as of the temperature sensing element 5 used for the first to the sixth embodiments. The remaining lower space 76*s* in the container 76 below the element 77 is the space into which the element 77 will drop when the element 77 melts. A flux oil is applied onto the inside wall of the container 76 in the lower space 76*a* section in order to facilitate the molten element 77 to flow down along the inside wall.

Between the connecting member 74 and the top end of the temperature sensing element container 76 in the case 70 is disposed a compression coil spring 78. A holding pin 79 is also disposed in the case in a manner that the top thereof is securely attached to the connecting member 74, a top part 79*a* thereof is through the coil spring 78 and the top opening of the container 76, and a bottom part 79*b* thereof is securely embedded in the temperature sensing fuse element 77. Thus, the connecting member 74 is normally securely kept by the holding pin 79 from moving when the fuse element 77 is in a solid state but upwardly urged by the compression coil spring 78.

Leaf springs may be substituted for the coil spring 78, or a tension coil spring may be disposed in the space 71*s* to keep pulling up the connecting member 74 instead of using the coil spring 78.

When an excessive current flows through the fuse unit 1G, the fuse element 73*a* of the current sensing fuse 73 will melt down and the lead terminals 72*a* and 72*b* will be electrically disconnected from each other. The connecting member 74 is kept from moving as long as the temperature sensing fuse element 77 is in a solid state. When the temperature sensing element 77 melts at a specified ambient temperature, the holding pin 79 will be released from the element 77 and the connecting member 74 will be flipped up by the upwardly urging force of the coil spring 78, as shown by an arrow 'c' in FIG. 12, and, consequently, the part 74*a* of the connecting member 74 will come apart from the end contact 73*c*2 of the current sensing fuse 73, whereby the lead terminals 72*a* and 72*b* will be electrically disconnected from each other.

Figure 13:
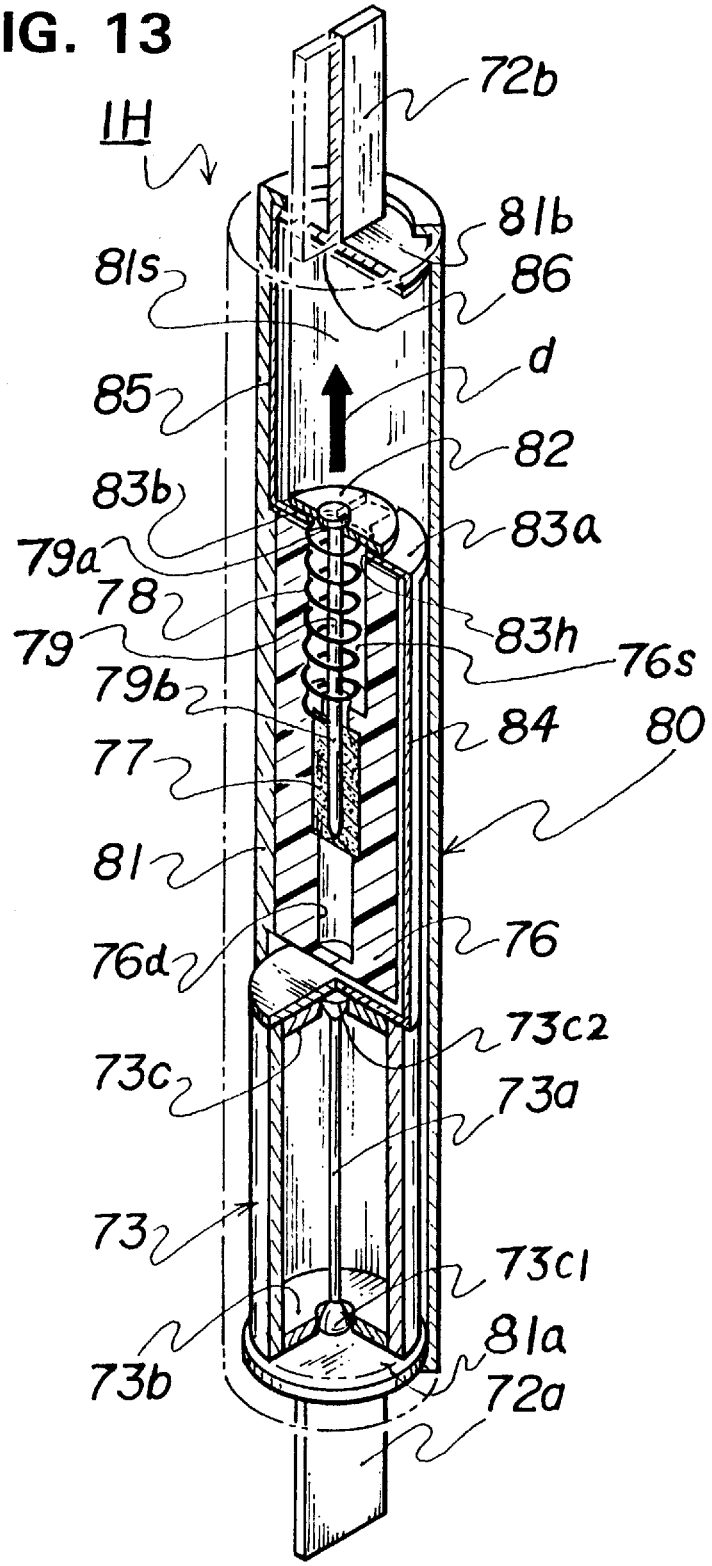
FIG. 13 is a partially cutout perspective view of a dual-functional fuse unit according to the eighth embodiment of the present invention.

FIG. 13 is a partially cutout perspective view of a dual-functional fuse unit 1H that is responsive to electric current and ambient temperature according to the eighth embodiment of the present invention.

The fuse unit 1H has an electrically non-conductive case 80 that includes a cylindrical case body 81 and a pair of end plates 81*a,* 81*b* fitted to both the ends of the case body 81. Lead terminals 72*a* and 72*b* are implanted to the end plates 81*a* and 81*b,* respectively. In a lower section within the case 80 is disposed a current sensing fuse 73, which has a fuse element 73*a,* a body 73*b* and end contacts 73*c*1, 73*c*2. The end contact 73*c*1 is electrically connected with the lead terminal 72*a*. On top of the current sensing fuse 73 and in a mid section within the case 80 is disposed an electrically non-conductive temperature sensing fuse container 76.

A pair of semicircular conductor plates 83*a* and 83*b* are disposed on top of the container 76 in a manner that the conductor plates 83*a* and 83*b* are spaced from each other leaving a gap 83*h* therebetween. A circular bridging conductor 82 is placed on the conductor plates 83*a* and 83*b* in a manner that the conductor plates 83*a* and 83*b* are normally electrically connected with each other through the bridging conductor 82. The end contact 73*c*2 of the current sensing fuse 73 is electrically connected with the conductor plate 83*a* through a conductor 84 and the conductor plate 83*b* is electrically connected with the lead terminal 72*b* through another conductor 85. Thus, the lead terminals 72*a* and 72*b* are normally electrically connected with each other through the current sensing fuse 73, the conductor 84, the conductor plate 83*a,* the bridging conductor 82, the conductor plate 83*b* and the conductor 85. Between the bridging conductor 82 and the end plate 81*b* within the case 80 is a space 81*s*.

The temperature sensing fuse container 76 has, in a diametrically mid section thereof, a spring accommodating space 76*s,* a temperature sensing fuse element 77 and a fuse element drain hole 76*d,* arranged vertically (as viewed in FIG. 13) in this order from the top. A compression coil spring 78 is disposed in the spring accommodating space 76*s* in a manner that the top end of the spring 78 is in contact with the bridging conductor 82 so that the bridging conductor 82 is upwardly (as viewed in FIG. 13) urged by the spring 78. A holding pin 79 is disposed in the container 76 through the spring 78 in a manner that a top part 79*a* thereof is securely connected to the bridging conductor 82, a lower part 79*b* thereof is securely embedded in the fuse element 77, and the bridging conductor 82 normally maintains contacts with both the conductor plates 83*a* and 83*b*.

The compression coil spring 78 may be replaced by a leaf spring, or by a tension coil spring that will be disposed in the space 81*s*.

An electrically-insulating coating 86 is applied on the conductor 85 and any other conductor exposed to the space 81*s* so that the bridging conductor 82 or the spring 78 may not accidentally and directly touch the conductor 85 or other conductor when the bridging conductor 82 and the spring 78 are flipped up into the space 81*s,* as mentioned below.

When an excessive current flows through the fuse unit 1H, the fuse element 73*a* of the current sensing fuse 73 will melt down and the lead terminals 72*a* and 72*b* will be electrically disconnected from each other. When the temperature sensing fuse element 77 melts at a specified ambient temperature, the molten element 77 will drop into the drain hole 76*d.* At the same time, the holding pin 79 will be released from the element 77 and the bridging conductor 82 will be flipped up by the upward urging force of the coil spring 78 into the space 81*s,* as shown by the arrow 'd' in FIG. 13. Consequently, the conductor plates 83*a* and 83*b* will be electrically disconnected from each other, whereby the lead terminals 72*a* and 72*b* will also be electrically disconnected from each other.

Figure 14:
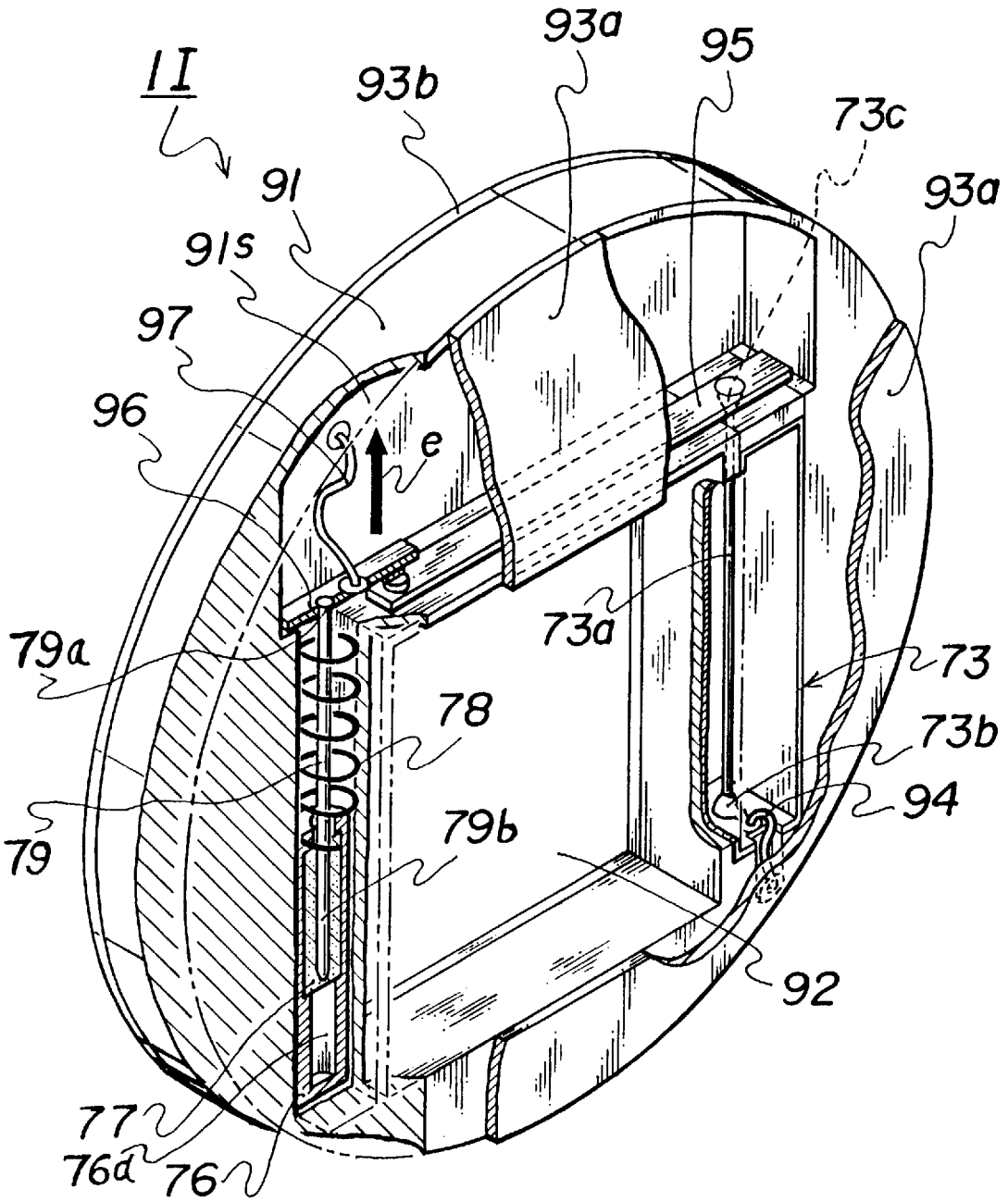
FIG. 14 is a partially cutout perspective view of a dual-functional fuse unit according to the ninth embodiment of the present invention.
Figure 15A:
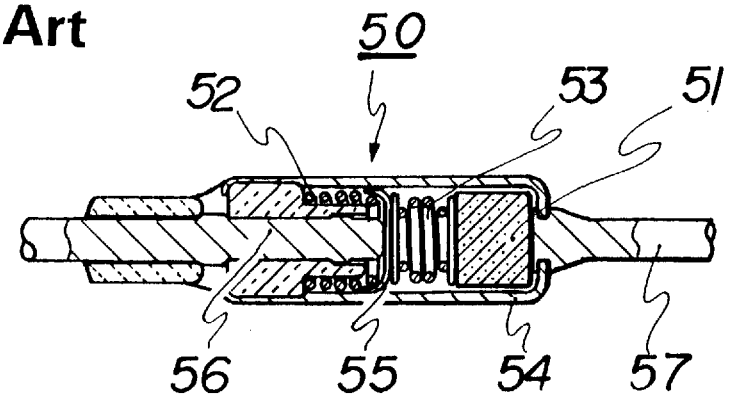
FIG. 15(A) Prior Art
FIGS. 15(A) and 15(B) show a conventional ambient temperature sensing fuse.
Figure 15B:
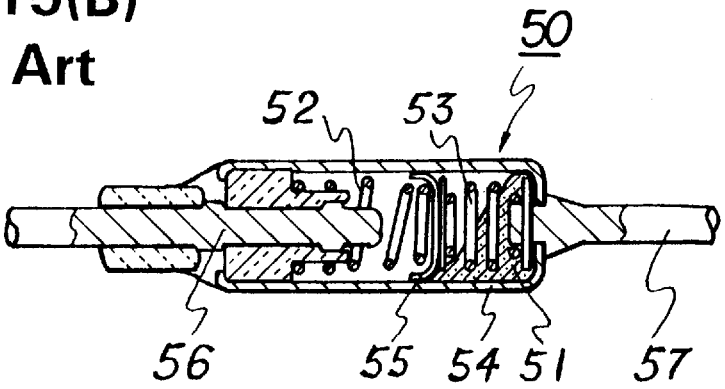
FIG. 15(B) Prior Art
Figure 16A:
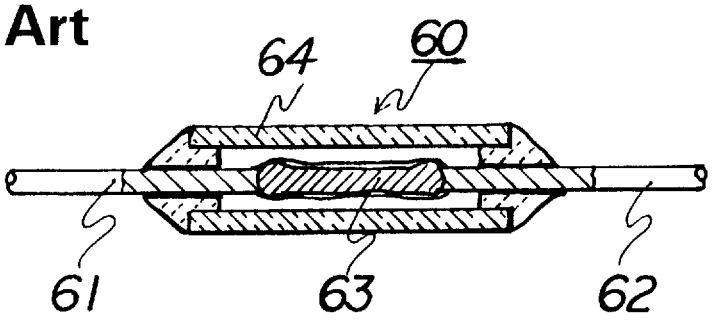
FIG. 16(A) Prior Art
FIGS. 16(A) and 16(B) show another type of conventional ambient temperature sensing fuse.
Figure 16B:
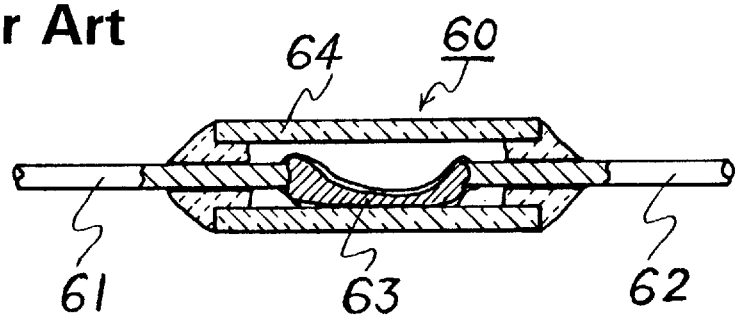
FIG. 16(B) Prior Art

FIG. 14 is a partially cutout perspective view of a dual-functional fuse unit 1I that is responsive to electric current and ambient temperature according to the ninth embodiment of the present invention.

The fuse unit 1I has an electrically non-conductive disc-shaped case 91 having a rectangular through hole 92 in approximately the diametrical center thereof. Electrically-conductive circular terminal plates 93*a* and 93*b* are fixedly attached to sides of the case 91 in a manner that the case 91 is sandwiched therebetween. The terminal plates 93*a,* 93*b* have the same diameter as of the case 91 and respective rectangular holes that match the hole 92 of the case 92. Incidentally, the circular shape and size of the fuse unit 1I match those of small disc-shaped batteries.

Within the case 91, a current sensing fuse 73 is disposed on one side of the hole 92 and a temperature sensing fuse container 76, a compression coil spring 78 and a holding pin 79 are disposed on the other side thereof. The current sensing fuse 73 has a fuse element 73*a* and end contacts 73*b,* 73*c*. The end contact 73*b* is electrically connected with the terminal plate 93*a* by a conductor wire 94. The temperature sensing fuse container 76 has therein a temperature sensing fuse element 77 in an upper section thereof and a fuse element drain hole 76*d* therebelow, arranged vertically (as viewed in FIG. 14).

An elongated conductor plate 95 and an electrically-conductive contact plate 96 are disposed within the case 91 in an area on the rectangular hole 92. The conductor plate 95 is electrically connected with the end contact 73*c* in one end thereof and is in contact with the contact plate 96 in the other end thereof. The contact plate 96 is electrically connected with the terminal plate 93*b* by a flexible conductor wire 97. A space 91*s* is provided above the contact plate 96 in the case 91.

The compression coil spring 78 is disposed between the temperature sensing fuse container 76 and the contact plate 96 so that the contact plate 96 is upwardly (as viewed in FIG. 14) urged by the spring 78. The holding pin 79 is disposed through the spring 78 in a manner that a top part 79*a* thereof is fixedly attached to the contact plate 96, a lower part 79*b* thereof is securely embedded in the fuse element 77, and the contact plate 96 normally maintains contact with the conductor plate 95. Thus, the terminal plates 93*a* and 93*b* are normally electrically connected with each other through the lead wire 94, the current sensing fuse 73, the conductor plate 95, the contact plate 96 and the conductor wire 97.

When an excessive current flows through the fuse unit 1I, the fuse element 73*a* of the current sensing fuse 73 will melt down and the lead terminal plates 93*a* and 93*b* will be electrically disconnected from each other. When the temperature sensing element 77 melts at a specified ambient temperature the molten element 77 will drop into the drain hole 76*d.* At the same time, the holding pin 79 will be released from the element 77 and the contact plate 96 will be flipped up by the upward urging force of the coil spring 78 into the space 91*s,* as shown by the arrow 'e' in FIG. 14. Consequently, the contact plate 96 will be electrically disconnected from the conductor plate 95, whereby the lead terminals 72*a* and 72*b* will also be electrically disconnected from each other.

Effects of the Invention

In the present invention, since no temperature sensing fuse is directly connected to the circuit to be protected, the current sensing fuse can be selected on the actually allowable maximum current in the circuit. Consequently, a system shutdown caused by an erroneous action of a temperature sensing fuse, which often occurs with a conventional ambient temperature sensing fuse, can be obviated.

Furthermore, since the melting of the temperature sensing fuse element triggers a spring action and this spring action causes to instantly drive off the current sensing fuse, or an intermediate conductor member, that is connected in series between the lead terminals of the fuse unit, the current supply to the system circuit can infallibly be interrupted at the yielding temperature of the temperature sensing element. Thus, the reliability of the fuse unit as an ambient temperature sensing fuse is enhanced.

In addition, since the current sensing fuse and the temperature sensing fuse components are contained in a single case, yet the current sensing and the temperature sensing actions are independent from each other, the dual-functional fuse unit can be made substantially compact as compared to conventional two separate fuses, one for current sensing the other for temperature sensing. The dual-functional fuse unit can, therefore, contribute to a size reduction of the circuitry, which has positively been demanded in recent years.

It should be understood that various changes and modifications may be made in the above described embodiments which provide the characteristics of the present invention without departing from the spirit and principle thereof particularly as defined in the following claims.

What is claimed is:

1. A dual-functional fuse unit that is responsive to an electric current and an ambient temperature, the fuse unit comprising:

(a) a case;

(b) a pair of lead terminals attached to said case;

(c) a temperature sensing fuse element securely disposed in said case when said temperature sensing fuse element is in a solid state;

(d) a current sensing fuse disposed in said case, said current sensing fuse being electrically connected with and between said lead terminals;

(e) means for keeping said current sensing fuse from moving when said temperature sensing fuse element is in a solid state; and (f) a magnetic means for urging said current sensing fuse so that when said fuse element melts at a specified ambient temperature said current sensing fuse is displaced by said urging means and the electrical connection between said lead terminals is cut off.

2. A dual-functional fuse unit that is responsive to an electric current and an ambient temperature, the fuse unit comprising:

(a) a case;

(b) a pair of lead terminals attached to said case;

(c) a temperature sensing fuse element fixedly disposed in said case when said temperature sensing fuse element is in a solid state;

(d) a current sensing fuse having a current sensing fuse element disposed in said case, said current sensing fuse element being electrically connected with and between said lead terminals;

(e) a compression coil spring disposed in said case between said temperature sensing fuse element and said current sensing fuse;

(f) a holding pin, having a first end and a second end, disposed in said case through said coil spring in a manner that said first end is fixedly attached to one end of said coil spring and said second end is securely embedded in said temperature sensing fuse element when said temperature sensing fuse element is in a solid state so that said coil spring is kept from expanding by said holding pin when said temperature sensing fuse element is in a solid state; and (g) a sharp cutter piece fixedly attached to said end of said coil spring in a manner that said cutter piece is directed towards said current sensing fuse element so that when said temperature sensing fuse element melts at a specified ambient temperature, thereby causing said holding pin to be released from said temperature sensing fuse element, said cutter piece is driven towards said current sensing fuse element by said spring and said current sensing fuse element is severed by said cutter piece and the electrical connection between said lead terminals is cut off.

3. A dual-functional fuse unit according to claim 2, wherein said current sensing fuse element is contained in a fuse body that has a hole in a manner that said hole opposes said coil spring so that said cutter piece attached to said end of said spring is driven to said current sensing fuse element by said spring through said hole when said temperature sensing fuse element melts.

4. A dual-functional fuse unit that is responsive to an electric current and an ambient temperature, the fuse unit comprising:

(a) a case;

(b) a pair of lead terminals attached to said case;

(c) a temperature sensing fuse element fixedly disposed in said case when said temperature sensing fuse element is in a solid state;

(d) a current sensing fuse disposed in said case;

(e) a conductor member disposed in said case, said current sensing fuse and said conductor member being electrically connected with each other in series and further electrically connected with and between said pair of lead terminals in series;

(f) a compression coil spring disposed in said case between said temperature sensing fuse element and said conductor member for urging said conductor member in a direction away from said fuse element; and (g) a holding pin disposed in said case through said coil spring for keeping said conductor member from moving when said temperature sensing fuse element is in a solid state, said holding pin having a first part and a second part, said first part being fixedly attached to said conductor member and said second part being securely embedded in said fuse element so that when said fuse element melts at a specified temperature said holding pin is released from said fuse element and said conductor member is displaced by the urging force of said spring and the electrical connection between said first and second lead terminals is cut off.

5. A dual-functional fuse unit that is responsive to an electric current and an ambient temperature, the fuse unit comprising:

(a) a case;

(b) a pair of lead terminals attached to said case;

(c) a temperature sensing fuse element securely disposed in said case when said temperature sensing fuse element is in a solid state;

(d) a current sensing fuse, having a fuse body, disposed in said case, said current sensing fuse being electrically connected with and between said lead terminals;

(e) a compression coil spring disposed in said case between said temperature sensing fuse element and said fuse body for urging said current sensing fuse in a direction away from said temperature sensing fuse element; and (f) a holding pin, having a first end and a second end, disposed in said case through said coil spring in a manner that said first end is attached to said fuse body and said second end is securely embedded in said temperature sensing fuse element when said fuse element is in a solid state so that said current sensing fuse is kept from moving by said holding pin when said fuse element is in a solid state but when said fuse element melts at a specified ambient temperature said second end of said holding pin is released from said fuse element, whereby said current sensing fuse is displaced by said coil spring and the electrical connection between said lead terminals is cut off.

6. A dual-functional fuse unit according to claim 5, wherein the fuse unit further has a plurality of straight ribs that are parallel with one another on inside walls of said case in a manner that parts of said current sensing fuse are individually in slidable contact with said ribs.

7. A dual-functional fuse unit that is responsive to an electric current and an ambient temperature, the fuse unit comprising:

(a) a case;

(b) a first lead terminal and a second lead terminal, both attached to said case;

(c) a temperature sensing fuse element securely disposed in said case when said temperature sensing fuse element is in a solid state;

(d) a current sensing fuse disposed in said case, said current sensing fuse having a fuse body, a first end contact and a second end contact, said fist end contact being pivotally and electrically connected with said first lead terminal, said second end contact being electrically connected with said second lead terminal;

(e) a compression coil spring disposed in said case between said temperature sensing fuse element and said current sensing fuse for urging said current sensing fuse in a direction away from said temperature sensing fuse element; and (f) a holding pin disposed in said case through said coil spring in a manner that one end thereof is pivotally connected with said fuse body and a part thereof is securely embedded in said temperature sensing fuse element when said fuse element is in a solid state so that said current sensing fuse is kept from moving by said holding pin when said fuse element is in a solid state but when said fuse element melts at a specified ambient temperature said holding pin is released from said fuse element, whereby said current sensing fuse is pivotally displaced by said coil spring and the electrical connection between said second end contact and said second lead terminal is cut off.

8. A dual-functional fuse unit according to claim 7, further comprising:

(g) a holding clip fixedly attached to one end of said second lead terminal, said second end contact being removably fitted in said holding clip when said temperature sensing fuse element is in a solid state.

9. A dual-functional fuse unit that is responsive to an electric current and an ambient temperature, the fuse unit comprising:

(a) an electrically non-conductive disc-shaped case having a rectangular through hole in approximately a diametrical center thereof;

(b) a pair of electrically conductive circular terminal plates fixedly attached to sides of said case in a manner that said case is sandwiched therebetween, each of said terminal plates having a diameter equal to a diameter of said case and a rectangular hole that matches said rectangular through hole of said case;

(c) a temperature sensing fuse element fixedly disposed in said case when said temperature sensing fuse element is in a solid state;

(d) a current sensing fuse disposed in said case;

(e) a conductor member disposed in said case, said current sensing fuse and said conductor member being electrically connected with each other in series and further electrically connected with and between said pair of terminal plates in series;

(f) means for keeping said conductor member from moving when said temperature sensing fuse element is in a solid state; and (g) means for urging said conductor member in a direction away from said temperature sensing fuse element so that when said temperature sensing fuse element melts at a specified temperature said conductor member is displaced by said urging means and the electrical connection between said terminal plates is cut off.

* * * * *